United States Patent [19]

Lewicki

[11] 4,101,863

[45] Jul. 18, 1978

[54] ANGULAR MOVEMENT RESOLVERS

[75] Inventor: Edward Lewicki, Cheltenham, England

[73] Assignee: S.L.M. (Model) Engineers Limited, Cheltenham, England

[21] Appl. No.: 753,784

[22] Filed: Dec. 23, 1976

[30] Foreign Application Priority Data

Apr. 8, 1976 [GB] United Kingdom ..... 14227/76

[51] Int. Cl.[2] ..... H01C 5/00; G05G 9/02

[52] U.S. Cl. ..... 338/128; 74/471 XY

[58] Field of Search ..... 338/128; 74/471 XY; 137/636.2

[56] References Cited

U.S. PATENT DOCUMENTS

| | | | |
|---|---|---|---|
| 2,379,778 | 7/1945 | Allen | 74/471 XY |
| 3,870,161 | 3/1975 | Cording | 74/471 XY |
| 3,870,986 | 3/1975 | Oka et al. | 74/471 XY |

*Primary Examiner*—Allan D. Herrmann

*Attorney, Agent, or Firm*—Young & Thompson

[57] ABSTRACT

In a control device of the "joystick" type in which movement of a single control lever is resolved into two orthogonal components, each component is represented by movement of one of a pair of pivoting members. Each such pivoting member has a respective coupling member mounted thereon for angular movement relative thereto about an axis perpendicular to the axis of the corresponding pivoting member. The two coupling members are connected to the control member so as to be restrained against relative translational movement.

8 Claims, 7 Drawing Figures

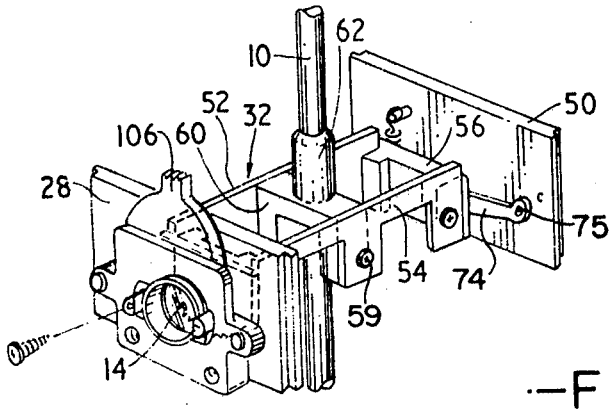
-FIG.1-
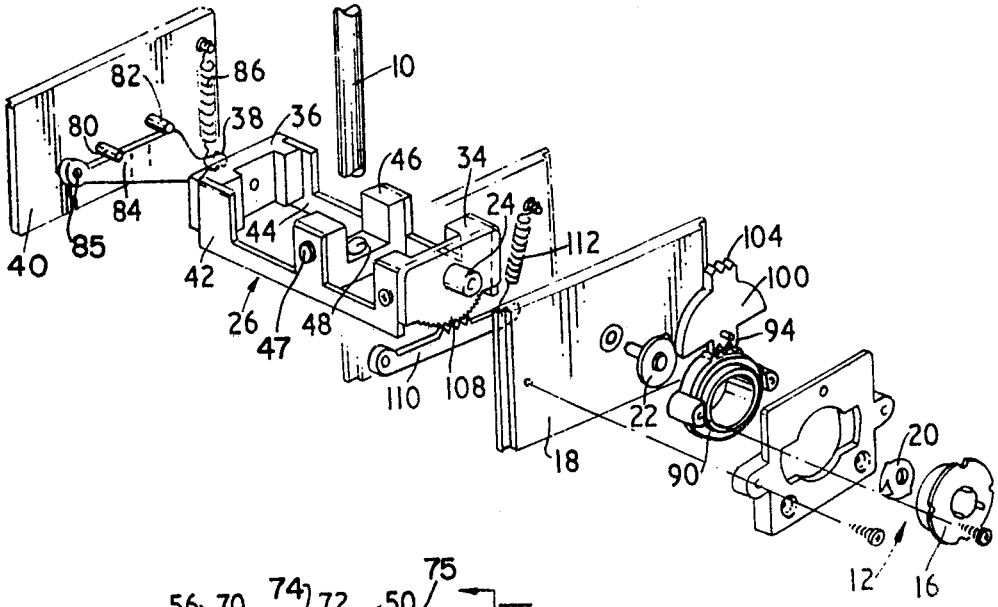
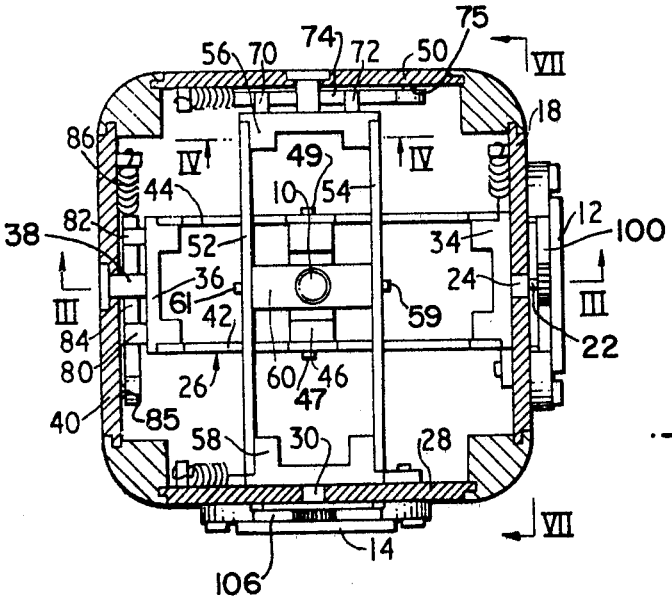
-FIG.2-

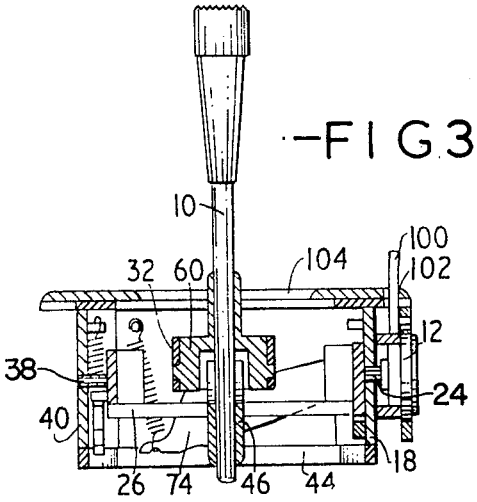
-FIG.3-
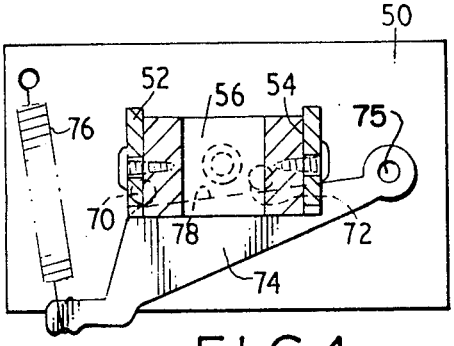
-FIG.4-
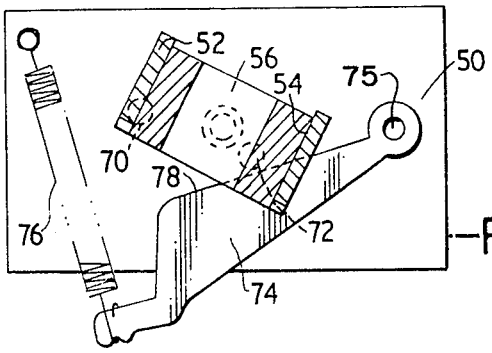
-FIG.5-
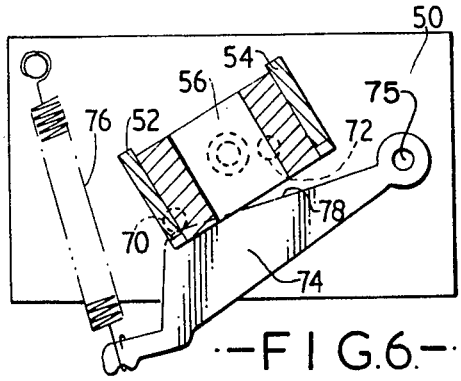
-FIG.6-
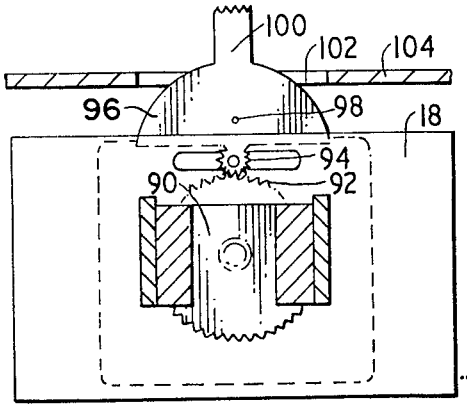
-FIG.7-

ANGULAR MOVEMENT RESOLVERS

FIELD OF THE INVENTION

This invention relates to devices for resolving the movement of a member, which is capable of angular motion about a set of coplanar axes having a common point of intersection, into components of angular movement about two mutually orthogonal axes in the plane of said coplanar axes. Devices in accordance with the invention can also be used for converting such two components back into the original angular movement. The invention is particularly applicable to control devices of the "joystick" type in which a single manually operable control lever is arranged to operate two rotary control elements, such as potentiometers, simultaneously.

BACKGROUND OF THE INVENTION

In one known control device of this type, two semi-circular members are mounted for angular movement about respective mutually orthogonal axes extending diametrically across the ends thereof. Each semi-circular member has a slot extending along the length thereof and a control lever projects through the slot of the two semi-circular members and is pivotally mounted at the point of intersection of the said orthogonal axes. A respective potentiometer is coupled to each of the semi-circular members. This device is subject to an undesirable amount of backlash, due to the flexibility of the semi-circular members, particularly when the control lever is in the quadrant of the control device opposite to the quadrant bounded by the two potentiometers. In another known control device, this problem is overcome by mounting one of the potentiometers within the semi-circular members. However it is then impossible to provide for a trim adjustment to be made between the angular position of each potentiometer and its corresponding semi-circular member. With such a control device it is usually necessary to provide electrical trimming arrangements in the circuits connected to the potentiometers which are thereby unnecessarily complicated.

SUMMARY OF THE INVENTION

The present invention is concerned with the provision of means for resolving angular movement into two mutually perpendicular components which can be used to provide a control device of the "joystick" type in which the potentiometers can be mounted in such a position that mechanical trim adjustment can be provided without the system being subject to undesirable backlash.

According to the invention, there is provided a control device comprising a pair of pivoting members mounted in a housing for angular movement about mutually orthogonal axes, each pivoting member having a respective coupling member mounted thereon for angular movement relative thereto about an axis perpendicular to the axis of the corresponding pivoting member, and a common connected to each of said coupling members so as to be restrained against relative translational movement in a plane containing the axis of pivotal movement of the corresponding coupling member, said four axes having a common point of intersection.

It is obviously necessary to ensure that the various pivoting members and coupling members do not collide with one another when performing their required angular movements over the selected operating range. For this purpose, each of the pivoting members preferably comprises an open frame having two side members extending parallel to its axis of angular movement and each of the coupling members is generally U-shaped with the limbs thereof pivotally connected to the side members of the frame forming the corresponding pivoting member. Each such coupling member has a socket symmetrically disposed with respect to the limbs of the U-shape for receiving the common member. Where the invention is used to provide a control device, the common member serves as the control lever.

BRIEF DESCRIPTION OF THE DRAWINGS

FIG. 1 is a partially exploded perspective view of an embodiment of the invention with part of the outer casing removed, FIG. 2 is a horizontal cross-sectional view of the embodiment shown in FIG. 2, FIG. 3 is a section taken on the line III—III in FIG. 1, FIG. 4 is a sectional view taken on the line IV—IV in FIG. 2, FIGS. 5 and 6 are sectional views similar to FIG. 4 but showing the mechanism in two alternative positions, and FIG. 7 is a sectional view taken on the line VII—VII in FIG. 2.

DESCRIPTION OF THE PREFERRED EMBODIMENT

Referring to FIGS. 1 to 3, a two-motion control device comprises a common control lever or "joystick" 10 arranged to operate to adjust two potentiometers 12 and 14 which are mounted with the axes of their wiper spindles mutually orthogonal. As can best be seen in FIG. 1, the potentiometer 12 has its resistance element 16 mounted on a side wall 18 of the control device housing and its wiper 20 coupled by a coupling 22 to a shaft 24 of a pivoting member 26. The potentiometers 14 similarly has its resistance element (not shown) mounted on a side wall 28 of the housing and its wiper (not shown) connected to a shaft 30 forming part of a second pivoting member 32. The axes of the shafts 24 and 30, about which the corresponding pivoting members 26 and 32 are angularly movable, are mutually orthogonal.

The pivoting member 26 comprises a first end member 34, to which the shaft 24 is attached, and a second end member 36 carrying a shaft 38 which is aligned with the shaft 24 and journaled in a side wall 40 of the housing opposite to the side wall 18. The two end members are interconnected by E-shaped side members 42 and 44, with the end members 34 and 38 attached to the outer limbs of the two E-shapes.

A U-shaped coupling member 46 is mounted with the ends of its limbs pivotally at 47 and 49 coupled to the ends of the centre limbs the two E-shaped members 42 and 44. The common control member 10 extends through a central socket 48 in the coupling member 46 and is a sliding fit therein.

The pivoting frame 32 is mounted between the side wall 28 and the opposite side wall 50. Its construction is identical with that of the pivoting frame 26 in that it comprises a pair of E-shaped side members 52 and 54 interconnecting a pair of end members 56 and 58 and at pivot parts 59 and 61, supporting a U-shaped coupling member 60 provided with a central socket 62 through which the control rod 10 projects. The two pivoting frames 26 and 32 are so disposed that the stems of the two E-shaped side members of one are disposed between the limbs of the two E-shaped side members of the other and the two coupling members 46 and 60 have their limbs similarly interleaved. Angular movement of the control rod 10 about the points of pivotable attachment of the U-shaped coupling member 46 to the pivoting frame 26 causes angular movement of the pivoting frame 26 about the shafts 24 and 38. Similarly, angular movement of the control rod 10 about its points of pivotable attachment of the U-shaped member 60 to the pivoting frame 32 causes corresponding angular movement of the pivoting frame 26 about the shaft 30. Angular movement of the control rod 10 in any intermediate direction causes angular movement of both pivoting frames 26 and 32. The resulting angular movements change the resistance settings of the potentiometers 12 and 14 so that electrical outputs, indicating the components of angular movement of the control rod 10 in two mutually orthogonal directions can be obtained. Such angular movements can take place without the pivoting frame 26 and coupling member 46 colliding with the pivoting frame 32 and the coupling member 62, at least within the required operating range.

To allow for small misalignments of the axes due to manufacturing tolerances, the control rod 10 is free-running in one of the sockets 48 and 62 to allow axial and rotary displacement. Preferably the control rod 10 is rigidly fixed in the other socket but, if preferred, it can be free-running in both sockets and restrained against axial displacement by other means.

Referring to FIGS. 2 and 4, a pair of studs 70 and 72 are mounted on the end member 56 of the pivoting frame 32 and project outwardly therefrom. A crank lever 74, which is pivotally mounted at 75 on the side wall 50, is resiliently biased by a spring 76 so that an edge thereof engages with both of the studs 70 and 72 when the pivoting frame 32 is in its central orientation. Displacement of the pivoting frame 32 in either direction causes one or other of the studs 70 and 72 to displace the lever 74 against the action of the spring 76 as shown in FIGS. 5 and 6 respectively. Thus the lever 74 and the spring 76 have the effect of spring-biasing the pivoting frame 32 into its central angular orientation. A similar arrangement of studs 80 and 82, a lever 84 pivotally mounted at 85 and a spring 86 (FIG. 1) operates to bias the pivoting frame 26 into its central angular orientation.

Referring to FIGS. 1, 3 and 7, in order to provide relative trim adjustment between the potentiometer 12 and the corresponding pivoting frame 26, the resistance winding 16 of the former is mounted on an annular member 90 for angular movement about the axis of the shaft 24. The annular member 90 has a toothed segment 92 which engages with a gear wheel 94 mounted on one end of a lever 96 which is pivotally mounted at 98 on the side wall 18. The other end 100 of the lever 96 projects through a slot 102 in the top 104 of the housing. Thus, the resistance value of the potentiometer when the pivoting frame 26 is in its central orientation, can be adjusted mechanically and there is no need to provide for zero adjustment in the associated electrical circuitry. A similar arrangement, including a lever 106 corresponding to the lever 96, is provided for adjusting the orientation of the potentiometer 14 relative to the corresponding pivoting frame 32.

As can best be seen in FIG. 1, the end member 34 of the pivoting frame 26 includes a serrated segment 108 which engages with a correspondingly serrated edge of a lever 110. The lever 110 is biased into engagement with the serrated segment 108 by a spring 112 so as to provide additional frictional resistance to movement of the pivoting frame 26, thereby to damp undesired small movement thereof. A similar arrangement (not shown) is provided for the pivoting frame 32.

I claim:

1. A control device comprising a pair of pivoting members mounted in a housing for angular movement about mutually orthogonal axes, each pivoting member having a respective coupling member mounted thereon for angular movement relative thereto about an axis perpendicular to the axis of the corresponding pivoting member, and a common member connected to each of said coupling members so as to be restrained against relative translational movement in a plane containing the axis of pivotal movement of the corresponding coupling member, said four axes having a common point of intersection.

2. A control device according to claim 1, wherein each of the pivoting members comprises a rectangular frame mounted for pivotal movement about an axis extending through and perpendicular to its end, and each of the coupling members comprising a respective U-shaped member having the ends of its limbs pivotally connected to the sides of the corresponding pivoting member and a centrally disposed socket through which the common member projects.

3. A control device according to claim 2, wherein the common member is a sliding fit in the socket of at least one of the coupling members.

4. A control device according to claim 2, wherein the sides of each pivoting member comprise respective E-shaped members with the ends of the frame attached to the end limbs of each E-shaped and the coupling members pivotally connected to the centre limbs thereof.

5. A control device according to claim 1, including means for resiliently biasing each of the pivoting members into respective predetermined angular orientations.

6. A control device according to claim 5, wherein the biasing means for each pivoting member comprises a cranked lever having a edge adapted to engage with at least one of a pair of projections on the pivoting member and a spring arranged to bias the lever into engagement with the projections.

7. A control device according to claim 1, wherein each pivoting member is connected to the wiper of a respective potentiometer, the resistance winding of which is coupled to a housing for the control device.

8. A control device according to claim 6, wherein the resistance winding of each potentiometer is coupled to the housing via means for varying the angular positions thereof relative to the housing.

* * * * *